US008776465B2

(12) United States Patent
Murphy

(10) Patent No.: US 8,776,465 B2
(45) Date of Patent: Jul. 15, 2014

(54) SECURITY SYSTEMS AND METHODS OF USING SAME

(75) Inventor: Thomas M. Murphy, Indian Wells, CA (US)

(73) Assignee: Heightened Security, Inc., Palm Desert, CA (US)

( * ) Notice: Subject to any disclaimer, the term of this patent is extended or adjusted under 35 U.S.C. 154(b) by 0 days.

(21) Appl. No.: 13/328,694

(22) Filed: Dec. 16, 2011

(65) Prior Publication Data

US 2012/0317893 A1 Dec. 20, 2012

Related U.S. Application Data

(60) Provisional application No. 61/424,498, filed on Dec. 17, 2010, provisional application No. 61/444,080, filed on Feb. 17, 2011.

(51) Int. Cl.
*E04C 1/00* (2006.01)
*G08B 13/22* (2006.01)
*E04F 19/00* (2006.01)

(52) U.S. Cl.
CPC ..... *E04F 19/00* (2013.01); *G08B 13/22* (2013.01)
USPC ..... 52/309.4

(58) Field of Classification Search
USPC ..... 52/28, 220.1, 220.2, 220.5; 256/4, 19; 362/600, 612, 147, 152, 276, 383, 362/217.1, 217.11, 217.12, 217.13, 217.14, 362/217.15, 217.16, 217.17; 340/693.5, 340/693.6, 693.9, 693.11, 693.12
See application file for complete search history.

(56) References Cited

U.S. PATENT DOCUMENTS

| | | | | |
|---|---|---|---|---|
| 4,005,397 | A * | 1/1977 | Blair | 340/526 |
| 5,022,781 | A | 6/1991 | Smith | |
| 5,404,685 | A * | 4/1995 | Collins | 52/309.7 |
| 6,456,198 | B1 * | 9/2002 | Kato et al. | 340/564 |
| 8,066,398 | B2 * | 11/2011 | Hartman | 362/145 |
| 2010/0096608 | A1 * | 4/2010 | McCarthy et al. | 256/19 |
| 2010/0224847 | A1 * | 9/2010 | Rowley et al. | 256/24 |
| 2011/0260880 | A1 * | 10/2011 | Dean et al. | 340/686.1 |
| 2013/0318887 | A1 | 12/2013 | Murphy | |

* cited by examiner

*Primary Examiner* — Jessica Laux
(74) *Attorney, Agent, or Firm* — K&L Gates LLP; Louis C. Cullman; Brian J. Novak

(57) ABSTRACT

Described herein are security systems for both preventing intrusion by an unwanted party and detecting or locating where the attempted intrusion has occurred. The security systems in a broad aspect comprise a wall, at least one elongated coupling member attachable to the wall, at least one partitioning member that is at least partially transparent, at least one proximity sensor system associated with at least one of the elongated coupling member or at least one partitioning member; and at least one light associated with the proximity sensor system that is activatable by the proximity sensor system.

23 Claims, 10 Drawing Sheets

SECURITY SYSTEMS AND METHODS OF USING SAME

FIELD OF THE INVENTION

The present invention relates to security system such as perimeter walls with intrusion prevention and detection systems.

BACKGROUND

The possession of valuable goods and the desire to keep loved ones safe generally requires a system and method for protection. Whether the valuable goods are small items like pieces of jewelry, important documents or the like, or large items like automobiles, televisions, or artwork, a means for securing these items is essential. For smaller items, a safe is generally an adequate first line of defense. Likewise for larger items, locks and other securing means are adequate.

However, such methods merely slow down a burglar. As technology evolves, so must the protection methods of possessions and loved ones. People commonly lock away valuables within their home and park their expensive cars within a locked garage. At this point, preventing burglars from even getting to the home would be ideal.

Various types of security are commonly implemented on both personal property and perimeters of associations or communities. These include roaming patrol, video surveillance, numerous types of motion detection, and various types of walls with prevention measures at the tops such as razor wire or even in primitive situations, broken glass bottles. Despite these measures, once a burglar has surpassed one or more of these measures, it becomes a burden to track the burglar down and depending on the size of the protected area, it may become an elaborate and time consuming process.

As such, there exists a need in the art for a perimeter security system than prevents intrusion and allows one to pinpoint exactly where the attempted intrusion has occurred.

SUMMARY

Generally described herein are security systems comprising a wall, at least one elongated coupling member attachable to the wall, at least one partitioning member that is at least partially transparent, at least one proximity sensor system associated with at least one of the elongated coupling member or the at least one partitioning member, and at least one light associated with the proximity sensor system and activatable by the proximity sensor system.

Also described herein generally are methods of physically securing an area of land comprising attaching at least one elongated coupling member to a wall surrounding the area of land, placing at least one partitioning member that is at least partially transparent on top of the wall to prevent an intrusion, associating at least one proximity sensor system with the at least one elongated coupling member or the at least one partitioning member to detect an intrusion, using at least one light associated with the proximity sensor system and activatable by the proximity sensor system to locate the intrusion; and securing the area of land.

In one embodiment, the at least one elongated coupling member is formed of foam, and the foam is polystyrene. The at least one elongated coupling member is attached to the wall using an adhesive, preferably one that can withstand the elements.

In another embodiment, the at least one partitioning member is a pane of glass, Plexiglas or acrylic. In an example embodiment, the partitioning member is a pane of glass. In another example embodiment, the partitioning member is acrylic.

In other embodiments, the at least one proximity sensor system is a motion detection system, a pressure detection system, a shock detection system, an infrared detection system or a combination thereof. The security system can further comprise at least one channel guide to secure the at least one partitioning member to the wall.

In one embodiment, the at least one light is a light emitting diode. The light can be any color, but in one example embodiment, the light is red as a warning.

Further, the security systems described herein generally can add about six inches to about six feet of height to the wall. In one embodiment, the security system adds about six inches to about two feet of height to the wall. In other embodiments, the security system adds about ten feet to about twelve feet of height to the wall. In still other embodiments, the security system adds only about three inches to about six inches of height to the wall.

In one embodiment a security system is described comprising an existing block wall, at least one foam member attached to the top of the existing block wall, at least one glass pane that is at least partially transparent, at least one proximity sensor system situated within at least one groove within the at least one foam member, and at least one light associated with the proximity sensor system and activatable by the proximity sensor system, wherein the security system adds about six inches to about two feet of height to the existing block wall.

DETAILED DESCRIPTION

Generally described herein are security systems for both preventing intrusion by an unwanted party and locating where the attempted intrusion occurred. The security systems, in a broad aspect, comprise a physical structure including for example, a wall, at least one elongated coupling member attachable to the wall, at least one partitioning member that is at least partially transparent, at least one proximity sensor system associated with the at least one elongated coupling member or the at least one partitioning member; and at least one light associated with the proximity sensor system that is activatable by the proximity sensor system.

Figure 1A:
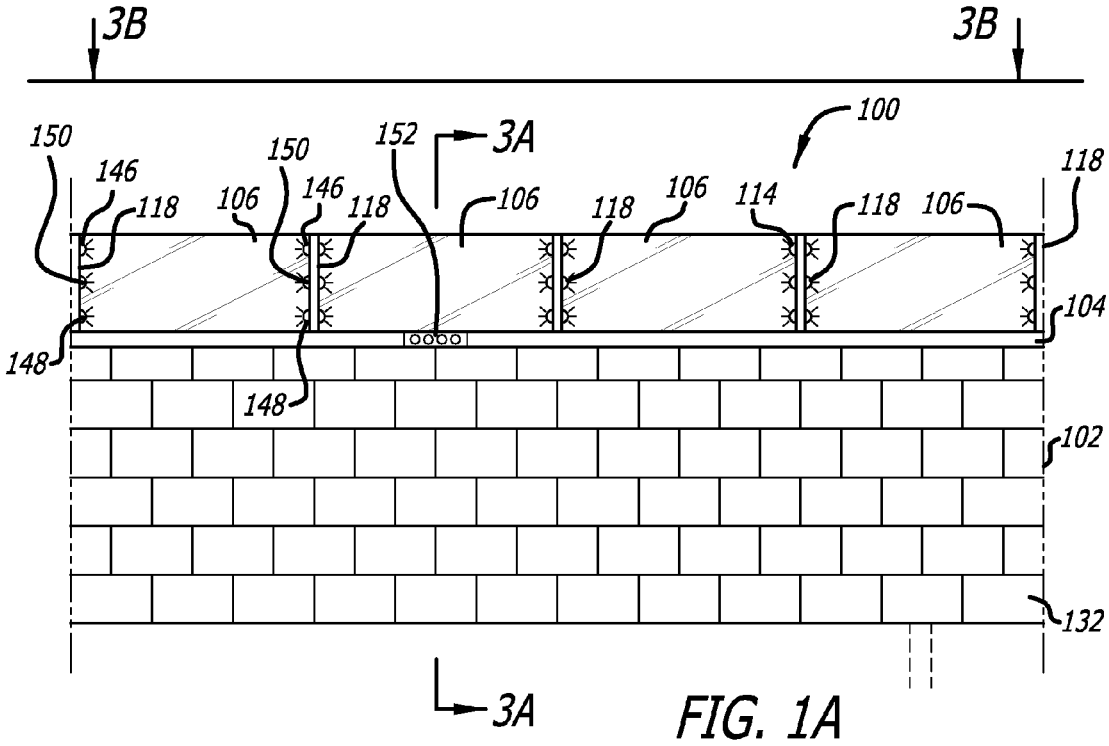
FIG. 1A illustrates an exterior view (from unsecured area) of an exemplary security system according to the present disclosure.
Figure 1B:
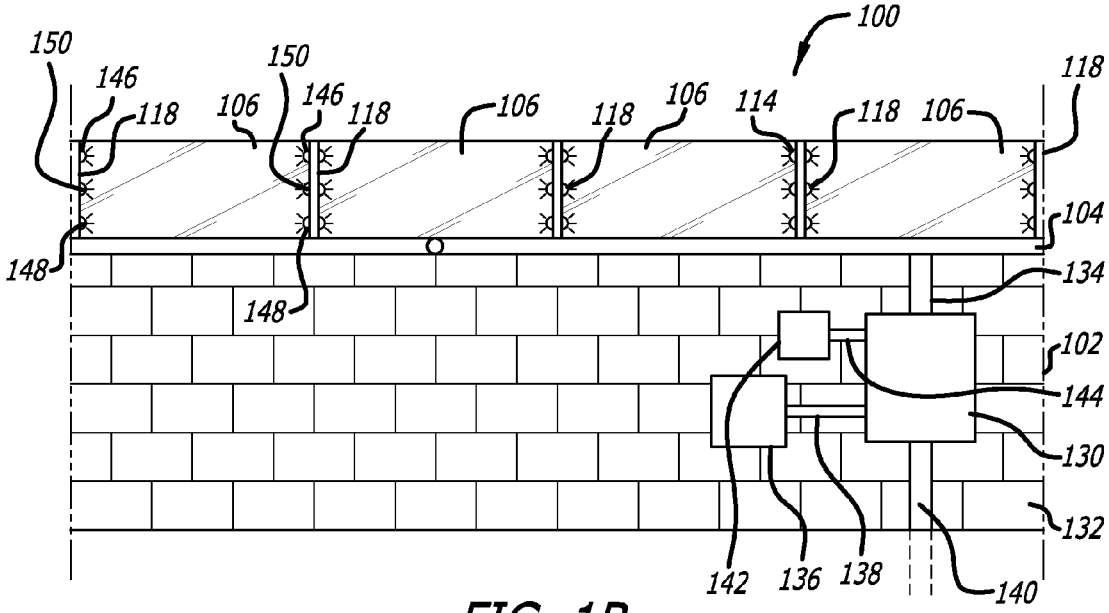
FIG. 1B illustrates an interior view (from secured area) the security system illustrated in FIG. 1A.
Figure 2A:
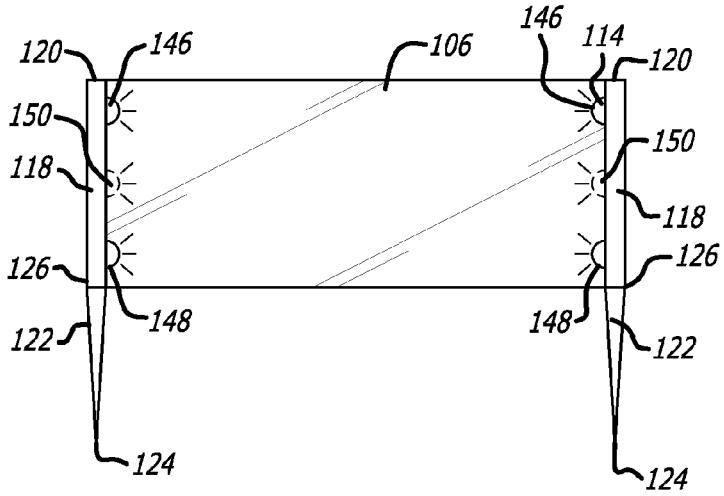
FIG. 2A is a view of a partitioning member and stakes according to the present description.
Figure 2B:
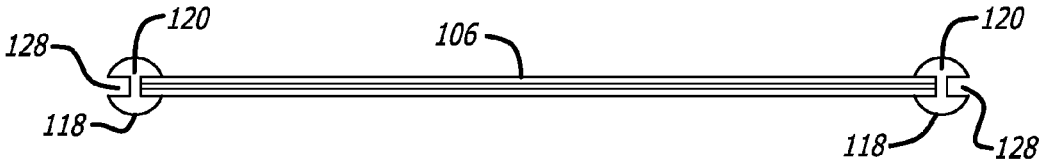
FIG. 2B is a top view of FIG. 2A.
Figure 3A:
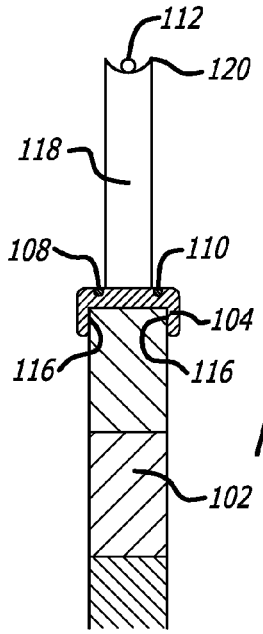
FIG. 3A is a cross-sectional view of FIG. 1.
Figure 3B:
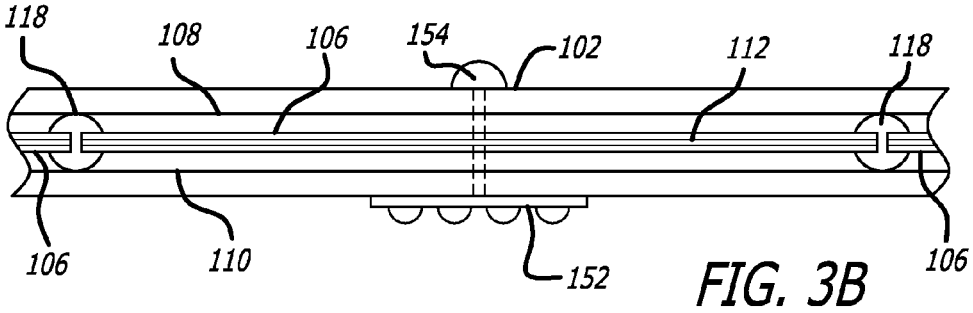
FIG. 3B is a top view of FIG. 1.

Referring to FIGS. 1-3, in one example embodiment, security system 100 comprises wall 102 on which at least one elongated coupling member 104 is attached. On top of elongated coupling member 104 is placed at least one partitioning member 106 that is at least partially transparent. At least one proximity sensor system 108, 110 is associated with at least elongated coupling member 104. At least one proximity sensor system 112 can also be associated with at least one partitioning member 106. Further still, at least one light 114 is associated with and is activatable by the proximity sensor system.

The wall can be formed of any appropriate material known in the art. Exemplary materials include cinder block, slump stone, cement, marble, stone, rock, wood, brick, chain link, glass, and the like.

The wall can further be formed of foam blocks cut into brick or stone dimensions and installed similar to a brick or stone wall. Foam blocks can be held together using any adhesive described herein or mortar. Once the wall is built, it can be sprayed and sealed using a polymeric coating material described herein.

In some example embodiments, the security systems are added to an existing wall. Such systems can be advantageous when local, state or federal ordinances restrict one's ability to add height to an existing wall. For example, in California where earthquake codes restrict block walls from being erected beyond six feet in height without cost prohibitive footings, the security systems described herein would be ideal.

In other situations, a security system might be advantageous over adding additional height to en existing wall that would not match the already existing aged walls. In other embodiments, the simplicity and tranquility of the security systems described herein may be desirable.

Even further still, the security systems described herein are visually appealing and more effective compared to common wall top security systems such as razor wire, spikes, or even glued down broken glass bottles.

Elongated coupling members as described herein can be formed from any appropriate material. Such materials include, but are not limited to, thermosets, thermoplastics, foams, coated foams, gels, and the like. The material needs to be rigid enough to hold an appropriate weight on top yet flexible enough to move when touched. The outside of the material has physical properties allowing it to hold up to heat, cold, ultraviolet light, rain, and the like over time.

In one example embodiment, elongated coupling members are formed of foam, for example compressed polystyrene. Compression ratios for the foams can be about 0.50, 0.60, 0.70, 0.75, 0.80, 0.90, or 1.0. The compression ratio can vary depending on, for example, the weight bearing load needed. In one embodiment, the foam is about 0.5 lb, 1.0 lb, 1.5 lb 2.0 lb or 2.5 lb foam.

The foam can be coated with a material selected from thermosets, thermoplastics, solidified gels, tar, stucco, resin, cement and the like. The coating can be for example a thermoplastic polyurethane and/or polyurea. Further, the coating material can have a UV resistant component to prevent excessive wear from sunlight. The coating can further armor the foam and as a result the elongated coupling members. A substance similar to resin sprayed in truck beds can be used to armor the foam. Once coated with such a coating material, the foam is able to withstand puncture, scratching, or water ingress.

In some embodiments, the elongated coupling members can be custom crafted using hot-wire sculpting to fit an type of decor or landscape theme. The coating can be of varying thickness depending on the particular application. Thickness can range from about 0.25 mil to about 50 mil. In one embodiment, the thickness is about 10 mil or about 20 mil.

Elongated coupling members can further be colored for visual appeal. That is, the elongated coupling members can come pre-painted or can be primed and pained or simply painted upon installation. It is common for fabricated building materials to come pre-primed ready for painting and the present elongated coupling members are no different. Painting the elongated coupling members should result in a durable coat of paint that will withstand the elements (i.e. sun, wind, rain, hail, snow, sleet, etc.) atop wall 102. For example, the paint coat should not crack or peal when exposed to the elements. In one embodiment, the elongated coupling members are compressed foam covered with a layered stucco which is infused with color before coating the foam (e.g. during the coating synthesis). In this case, the entire cement layer is colored so that the elongated coupling members do not need constant painting.

Elongated coupling members can be tailored to fit the top of any existing wall. For example, in the simplest case, the elongated coupling members can fit a wall with a square top. Or, the elongated coupling members can fit a wall with a rounded top. In the most complex situations the elongated coupling members can attach to non-uniform wall tops. In the worst case scenario, a rigid non-uniform wall top can be leveled with an appropriate concrete or mortar before installing the elongated coupling members.

Further, elongated coupling members can be fabricated to include indentations for partitioning members added on top, so that the partitioning members can sit snuggly on top of the elongated coupling members. Holes for installing mounting hardware (discussed below) can also be included.

In some example embodiments, elongated coupling members have at least one channel to run at least one proximity sensor system down the length thereof. In other embodiment, the elongated coupling members have two, three, four five, six, seven or more channels running through them. This channel can be deep enough to fully conceal the proximity sensor wire within the channel. In one example embodiment, elongated coupling members have two channels (proximity sensor system 108,110) to house a loop of proximity sensor wiring. In one channel the outbound wiring is housed and the inbound wiring is housed in a second channel. Once wires are embedded within the channels, they can be caulked in place to protect the wires from the elements.

Channels can be bored into elongated coupling member in virtually any configuration. For example, two holes can be bored in each outer edge on the elongated coupling member to hold a proximity sensor wire and a direct current power line.

Further, a channel can be bored, for example, under the partitioning member for wires such as for example, LED lighting strips.

Further, elongated coupling members can be cut at desired angles for assembling the security system. For example, 90° cuts and end caps where a wall ends, are useful. Further, miter cuts of the elongated coupling members are useful for turns in the wall, for example, a set of 45° miter cuts gives a 90° turn in the wall. Beveled cuts are also useful for elevation changes in a wall. Again, a set of 45° bevel cuts gives a 90° elevation change in the wall. Combinations of miter and bevel cuts can be made on the elongated coupling members to account for virtually any turn or elevation change in the wall.

Cuttablility of elongated coupling members is crucial for repair of a security system over time. Damage to a security system section may require that an assembled section be cut out and removed without substantially damaging wall 102. The materials used to form the elongated coupling members are easily cuttable under such circumstances.

In other embodiments, elongated coupling members can be formulated as preconfigured units including built in wiring, proximity sensor(s), lights and the like as desired for a particular installation. Upon installation, each preconfigured unit can have plugs at each end that connect together with adjacent preconfigured units for easy installation.

The size of wall 102 dictates the physical dimensions of elongated coupling members 104. For example, if wall 102 is formed of a standard 6 inch deep cinder block, then elongated coupling members 104 have a matching channel 116 on the bottom. In the case of a 6 inch cinder block, matching channel 116 might be 6 inches wide or even 6.25 inches wide to account for variations in block depth.

The height of the elongated coupling members 104 are generally on the order of about six inches to about ten feet or more. In other embodiments, the elongated coupling members are about six inches to about three feet tall. In yet other embodiments, the elongated coupling members are about six inches to about two feet tall.

Lengths of elongated coupling members 104 are dependent on the scope of security system being installed. In most cases, to save on cost, 2 ft, 4 ft, 6 ft, 8 ft or even 12 ft lengths might be ideal wherein appropriate lengths are cut at the installation site. However, short lengths such as 1 ft or less can be produced.

Elongated coupling members 104 are generally coupled to wall 102 using an adhesive such as acrylic latex, polystyrenes, polyurethanes, and combinations thereof.

Any common type of construction adhesive such as caulks, cements, mortars, polymeric adhesives and the like can be used. In addition to or as an alternative to adhesive, elongated coupling members 104 can be anchored to wall 102. Bolts and masonry anchors with washers can hold elongated coupling members 104 in place. In one example embodiment, elongated coupling members 104 are both glued and anchored to wall 102.

Further still, elongated coupling members 104 can be configured with a protruding channel along the bottom such that a groove is cut into the top of an existing wall and the elongated coupling members' protruding channel is placed into the newly cut groove. Again, the elongated coupling members can be glued or physically bolted down once placed within the groove atop the existing wall.

The at least one partitioning member 106 is formed of a material that can withstand the elements when placed on top of wall 102. In some embodiments, the at least one partitioning member 106 can be nontransparent, for example, if a user prefers privacy, transparency of the at least one partitioning member 106 is reduced or eliminated completely. In other embodiments partitioning member 106 is at least partially transparent. In some circumstances, transparency is vital for safety and or for visual appeal.

The at least one partitioning member 106 can be formed of materials such as, but not limited to glass, plexiglas, acrylic sheets, plastic, metal, or wood. Even nontransparent materials such as metal or wood can be made partially transparent by adding holes for visual appeal or as look out points.

As illustrated in FIG. 1, at least one partitioning member 106 is formed of glass, preferably soda lime glass. The glass can have any thickness known in the art depending on the particular security system specifications. For example, ⅛ in, ¼ in, ⅜ in, ½ in, ¾ in and even 1 in glass can be used. The panels can be, for example, 5 ft wide by 2 ft tall. The glass is preferably tempered shatterproof glass, but this is not a requirement. In other embodiments, layered tempered glass can include different colored sandwich layers to add visual appeal to the panels. Further still, the glass, plexiglass or acrylic material can be reinforced with wire mesh. Embodiments with additional sized and shaped glass will be described infra.

In one example embodiment, illustrated in FIGS. 1-3, ½ in glass is used because it is light enough the set atop elongated coupling members 104 yet strong enough to withstand the elements. Plexiglas is also an option as a partitioning member. Plexiglas is durable yet light weight when compared to soda lime glass. Acrylic that is shatter resistant and scratch resistant can also be used because of its strength, low weight and durability.

Whether glass, Plexiglas or acrylic is used as a partitioning member, one or more coatings can be applied to the material. For example, tinting, ultraviolet (UV) light filters, color layers and the like can be added to the material for both functional and visual appeal.

In some embodiments, each partitioning member 106 is held in place by at least one positioning stake 118. A positioning stake 118 can have several shapes and sizes depending on the type of wall 102 and partitioning member 106 used. As illustrated in FIGS. 1-3, positioning stake 118 has an elongated shape with top end 120 and bottom end 122, which is tapered, that terminated at point 124. The bottom end of stake 118 does not need to be tapered in all embodiments; rather, a non tapered end can be used as well. Generally, from top end 120 to mid point 126, at least one slot 128 is present wherein each partitioning member 106 is seated. Slot 128 is dimensioned based on the thickness of partitioning members 106. Slot 128 is placed on both sides of stake 118 when partitioning members 106 are located on both sides or can only have slot 128 on one side when used as an end cap. Further, in a straight line, slots 128 are oriented at about 180°, but slots 128 can vary depending on turns in wall 102 to accommodate the turn.

Stakes 118 are installed on top of and through elongated coupling members 104. Generally, the location of stake 118 is measured and a core hole is drilled through elongated coupling members 104 and into wall 112, in the case it is formed of cinder or other block. Stake 118 can be driven down into the hole or the hole first filled with mortar which later sets around bottom end 122. In an alternate embodiment, bottom end 122 comprises a screw thread so that stake 118 can be screwed down into the hole.

The at least one proximity sensor system 108, 110, 112 can be of any fence or wall intrusion detection system. For example, microwave cable systems, microphonic cable systems and fiber optic cable systems can be easily adapted to the present security systems. Further motion detection systems can be incorporated.

Figure 4:
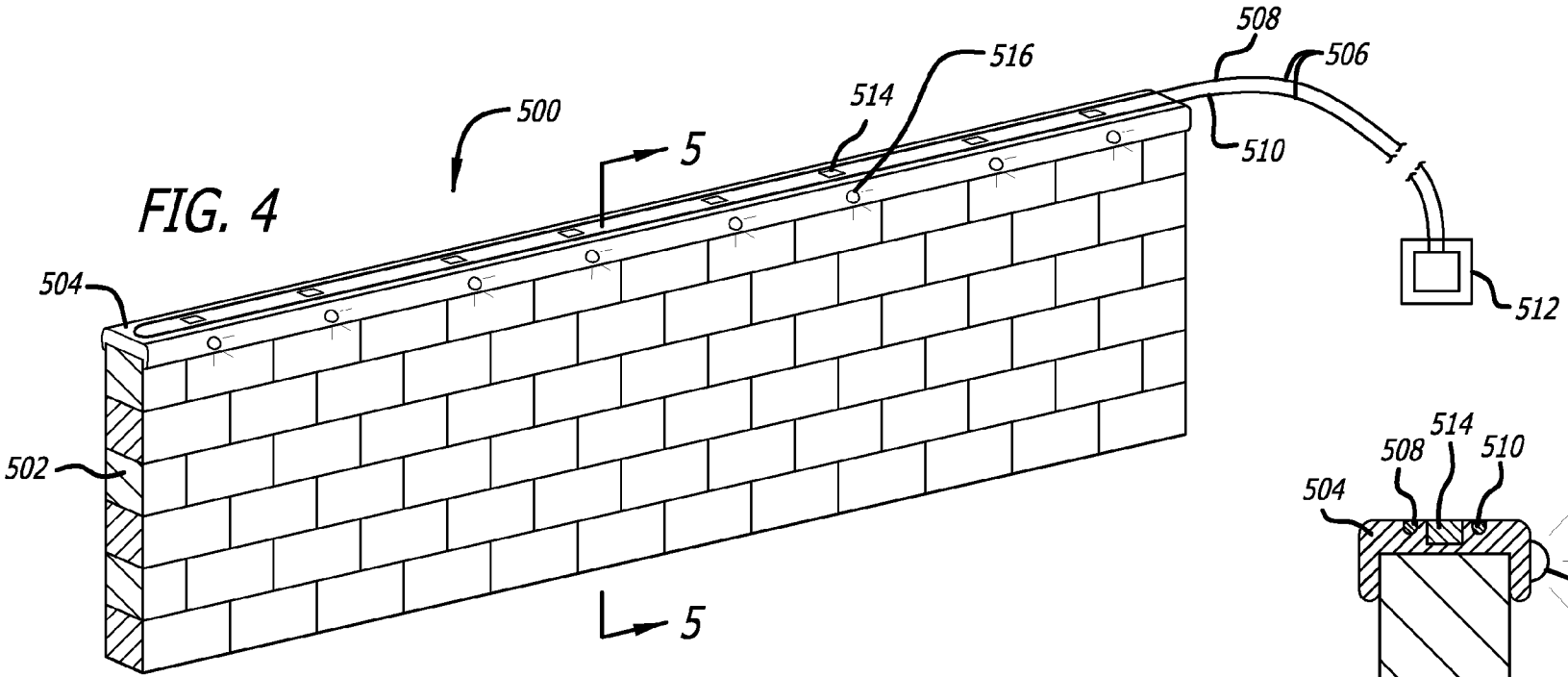
FIG. 4 is a perspective view of an example fiber optic proximity sensor system according to the present description.
Figure 5:
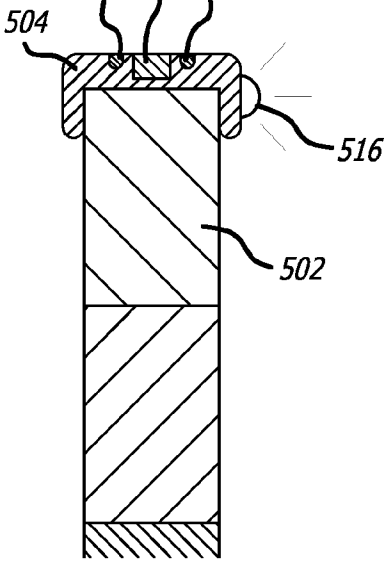
FIG. 5 is a cross-sectional view of FIG. 4.

A fiber optic proximity sensor system is illustrated in FIGS. 4-5 without partitioning members 106. Security system 500 comprises wall 502 capped with elongated coupling members 504. The proximity sensor system includes, in this particular example, fiber optic loop 506 having outbound wire 508 and inbound wire 510. Both outbound wire 508 and inbound wire 510 are terminated and ultimately controlled by controller module 512. Depending on the proximity sensor system utilized, multiple sensors 514 can be located along fiber optic loop 506 and trigger a sensor thereby illuminating a particular light 516. In other fiber optic systems, only a single strand of wire is needed instead of a loop. Such systems can detect intrusion within about 10 ft.

For example, in one embodiment, lights 516 can be illuminated white, at least from sunset to sunrise, and upon tripping of sensor 514 can change light 516 to a red color indicated the location of attempted penetration. In other embodiments, the lights might blink or might all turn red upon attempted penetration.

From FIGS. 4 and 5, light 516 can serve both a security function and a decorative function. All the lights described herein can sever both a security and decorative function as described here. As a security measure, each light 516 can illuminate to indicate where proximity sensor system had been tripped/activated. In another embodiment, the lights are simply decorative. For example, lights can change colors at random or in order for example to direct persons to the entrance to the secured area (in case of emergency) or can simply vary colors to look like decorative holiday lights. Such lighting system can be fitted to any security system described herein.

Figure 6:
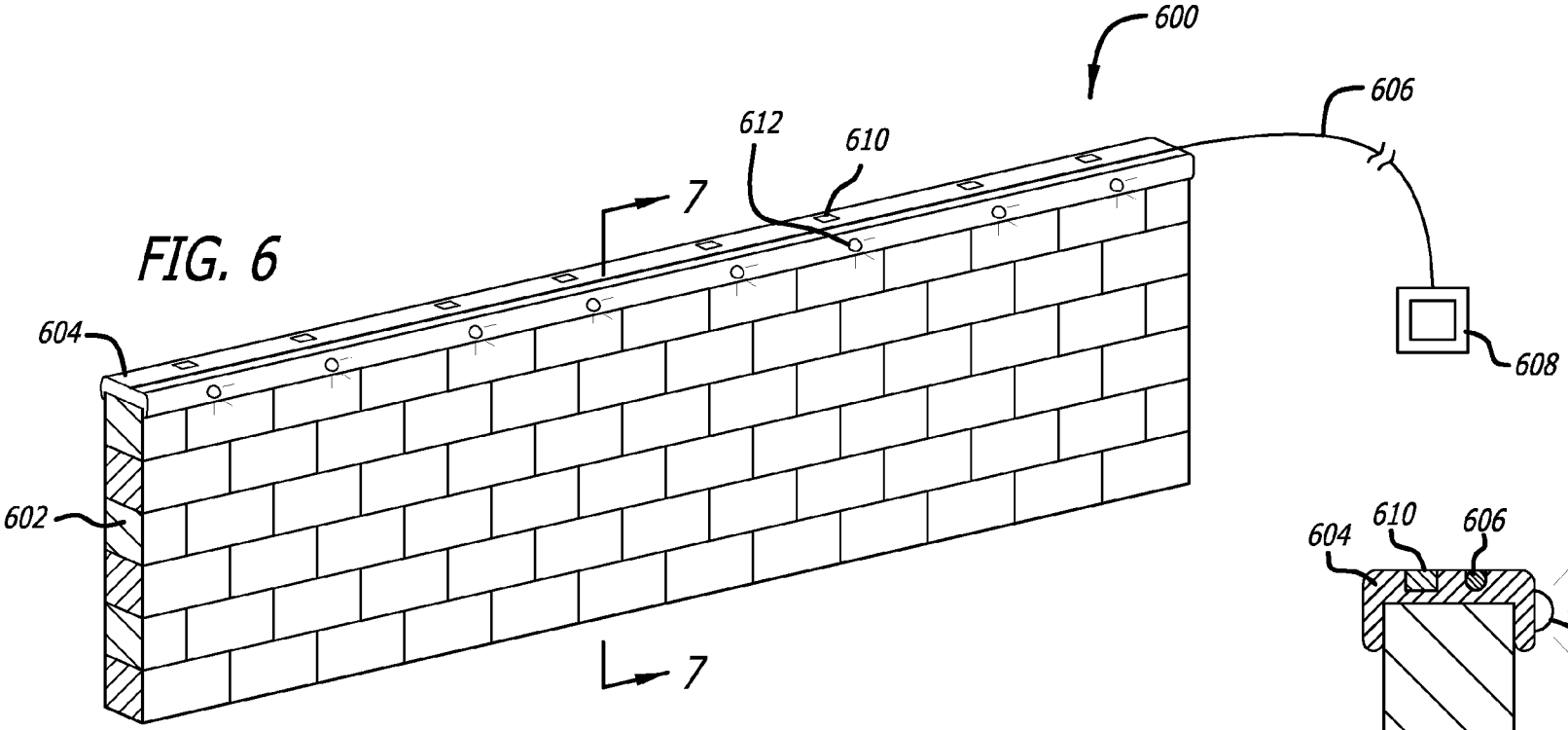
FIG. 6 is a perspective view of an example microwave proximity sensor system according to the present description.
Figure 7:
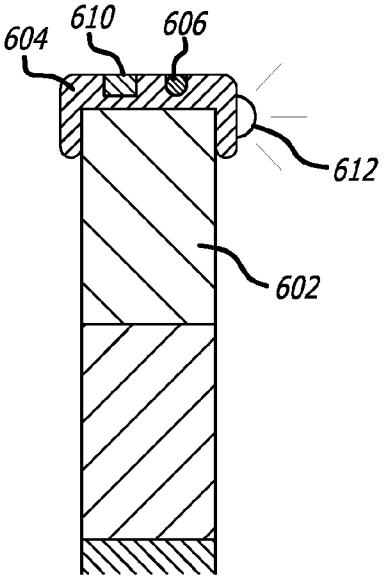
FIG. 7 is a cross-sectional view of FIG. 6.

A microwave proximity sensor system is illustrated in FIGS. 6-7 without partitioning members 106. Security system 600 comprises wall 602 capped with elongated coupling members 604. The proximity sensor system includes, in this particular example, analogue cable 606 terminated and ultimately controlled by controller module 608. Depending on the proximity sensor system utilized, multiple sensors 610 can be located along analogue cable 606 and trigger a sensor thereby illuminating a particular light 612.

In another example embodiment, a groove is cut into at leas the top edge of partitioning member 106 wherein a proximity sensor system 112 can be placed atop the entire security system. In such an embodiment, the edges of groove can be sharpened to add an extra layer of defense against intrusion.

A motion detection system can boarder the outside of the security system, for example. Laser systems that surround can be advantageous. Different lengths of laser motion detection systems can be used. For example, 500 foot spans can be used, or 1,000 foot spans, or 2,500 feet or more can be used. A break in the laser system can trigger an alarm or a particular light configuration as described herein.

In still another embodiment, the proximity sensor system 112 can surround the entire edge of each partitioning member 106 in a grove cut around the entire edge of each partitioning member. Such an embodiment allows for a sensor and warning system on each individual partitioning member.

Further, a proximity sensor system in the form of a motion detection system on the exterior portion of the wall can be activated in particular sections of the wall. Lights can be activated to warn a potential intruder that the wall is secured.

As illustrated in FIG. 1, controller module 130 can be, for example, mounted on inner face 132 of wall 102. Controller module 130 mounts on inner face 132 because it is important that potential burglars not have the ability to easily access it. Controller module 130 is connected to and controls the at least one proximity sensor system via cable 134. Controller module can further include at least one battery (not illustrated) that can be charged by an external source 136 via cable 138. External source can be, for example, a solar panel, wind turbine or the like. Controller module 130 can further be powered by an external power grid through main conduit 140.

Controller module 130 further communicates, in some embodiments, with a main controller system, for example, in a security headquarters in some cases on the protected property. Controller module 130 can collect via a communication line within main conduit 140 to a mainframe or server computer system. In other embodiments, communication with main controller system is via a wireless signal from antenna 142 through signal cable 144. Any wireless protocol known in the art can be used, but preferably, the wireless signal is encrypted above 64 bit.

The lighting systems of the described security systems can serve both a security function and a decorative function. As herein described, at least one light is associated with and activatable by at least one proximity sensor system. At least one light can also be associated with a controller system independent from a proximity monitoring system.

For example, as illustrated in FIG. 2A, each partitioning member 106 is flanked by two positioning stakes 118. Each stake can have a number of lights associated with it. Each stake 118 in FIG. 2A has four lights (two on each side, unless an end cap having two total). Upper light 146 and lower light 148 each can be illuminated on command. The lights can be associated with a proximity sensor system and activated when the system is tripped by a potential burglar. The colors of the light will vary greatly depending on the threat. For example, red might indicate danger, white might indicate intrusion in progress, and blue might indicate medical need, for example to signal paramedics to an onsite injury.

In another embodiment, upper light 146 and lower light 148 can be decorative in virtually any color. The lights can be dimmable and function from dusk to dawn to save on energy costs. The lights are preferably light emitting diodes (LEDs), but can be fitted with any type of light known in the art. In such an embodiment wherein upper and lower lights are decorative, in the case of danger, the lights can change from white to red. Or, in another embodiment, an additional middle light 150 can be added that is dedicated to the proximity sensor system and is, for example, red. In other embodiments there can be various numbers of lights and various different colors. Each particular system or section of a system can have a differing number and/or color of lights depending on the needs to the particular system.

In one example embodiment, upper light 146, lower light 148 and middle light 150 can be embedded within slot 128 of stake 118 so that the lights physically are not visible once the partitioning members are installed. Rather, the lights illuminate the panels from within the slots of the stakes.

Electronics such as light controllers, proximity system controllers and batteries or power converters can be built into selected stakes or each individual stake. If electronics are built into stake 128, for example lights, or even for decorative purposes, a cap can be placed on top of stakes 128. The cap can be glued, caulked, screwed down or snapped down to attain a seal. The cap can further comprise a solar panel that charges batteries either within a stake or somewhere else within the security system (e.g. within the foam).

Further rubber o-rings can be utilized to prevent moisture ingress into electronics built into the stakes. Further, the center portion of each stake can run on a drawer mechanism so that if lights or other electronics need replacing or servicing, the cap can be removed from the top and the drawer pulled upward revealing the components of the stakes' interior.

In another embodiment, light band 152 can be associated with a simple point of contact motion sensor system 154 that is embedded into elongated coupling members 104. With such a system, lights are simply activated when the motion sensor system is tripped/activated. Light band 152 can be a single light or a row or strand of lights. For example, light band 152 includes four lights.

Figure 8:
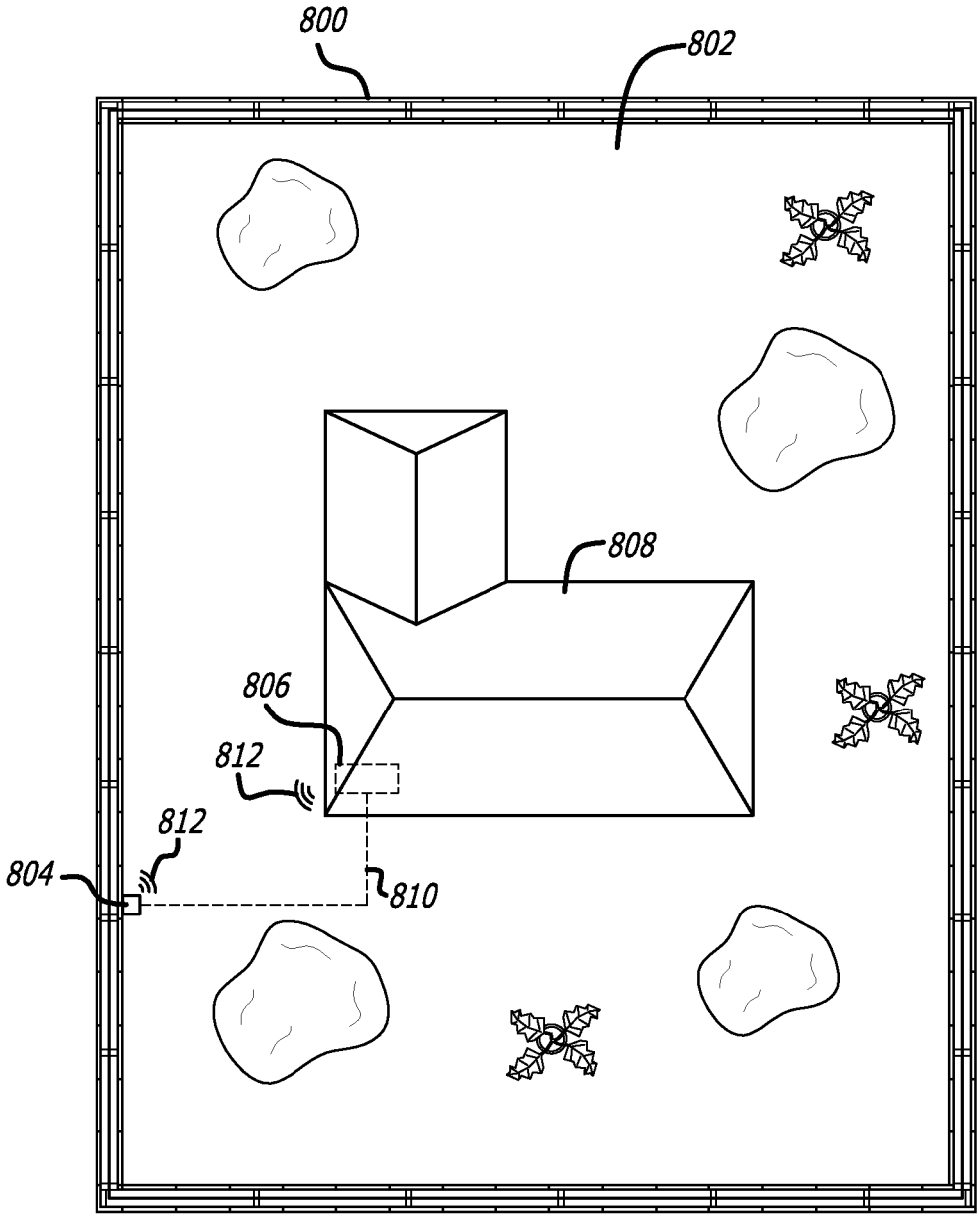
FIG. 8 is an aerial view of a security system according to the present disclosure.

As an example, FIG. 8 illustrates how a system as described can communicate and be controlled. Secured wall 800 including a security system as described herein surrounds the entirety of property 802. Control module 804 is located somewhere within secured wall 800. Control module 804 can communicate with main computer 806 within house 808 via communication line 810. Control module 804 can communicate with main computer 806 via wireless signal 812. Further still, controller module 804 can communicate with an offsite computer via telephone or fiber optic lines (not illustrated) or via a long range wireless signal such as a cellular network or satellite communication.

Main computer 806 can control virtually each electronic function of the security systems described herein. For example computer 806 can arm or disarm the entire system or any portion thereof. It can, for example, relay warning signals, dispatch onsite security or contact law enforcement automatically. It can collect data about the system including attempted intrusions, power usage and savings, light malfunctions and burnouts, and the like.

The entire system further comprises a redundant power system. One or more onsite power supplies are on standby in case external power is disrupted. These power supplies can be, for example, generators or batteries charged by solar panels. In some embodiments, the entire system is self contained in that all power is generated on site.

Figure 10:
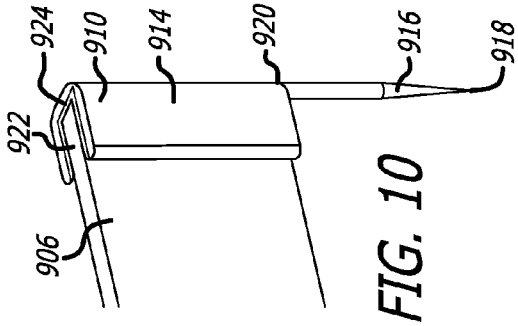
FIG. 10 illustrates a stake as used in the security system of FIG. 9.
Figure 9:
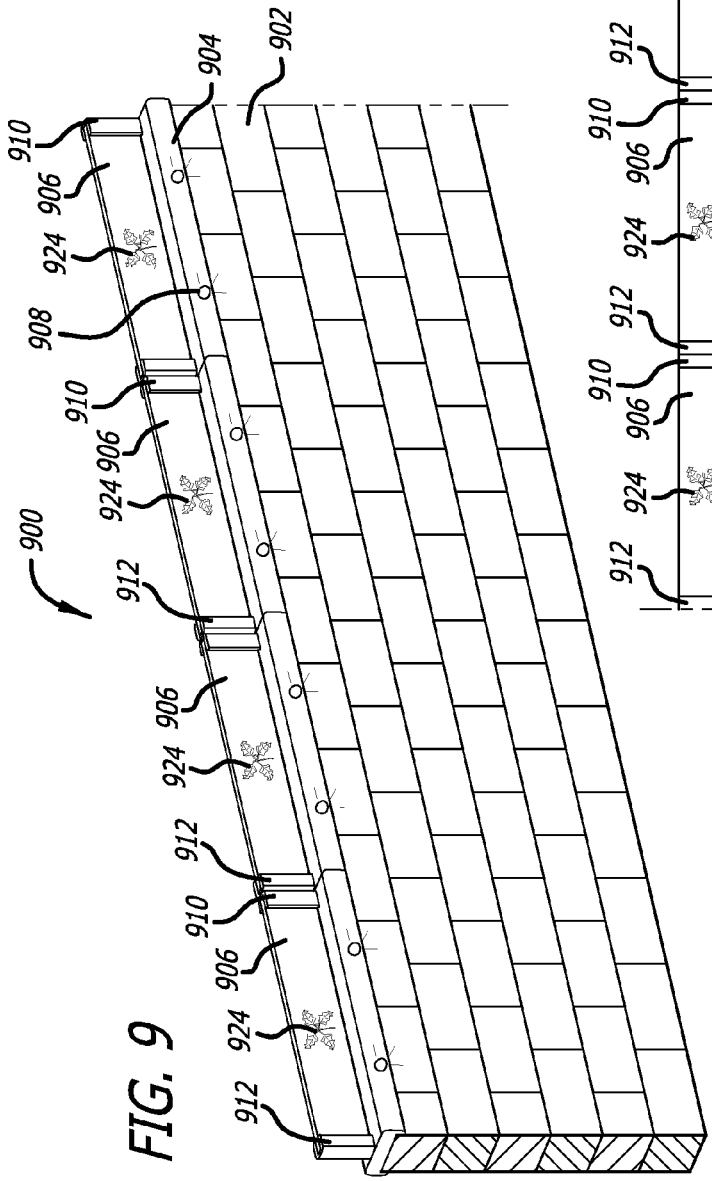
FIG. 9 illustrates an alternate security system according to the present disclosure.
Figure 11:
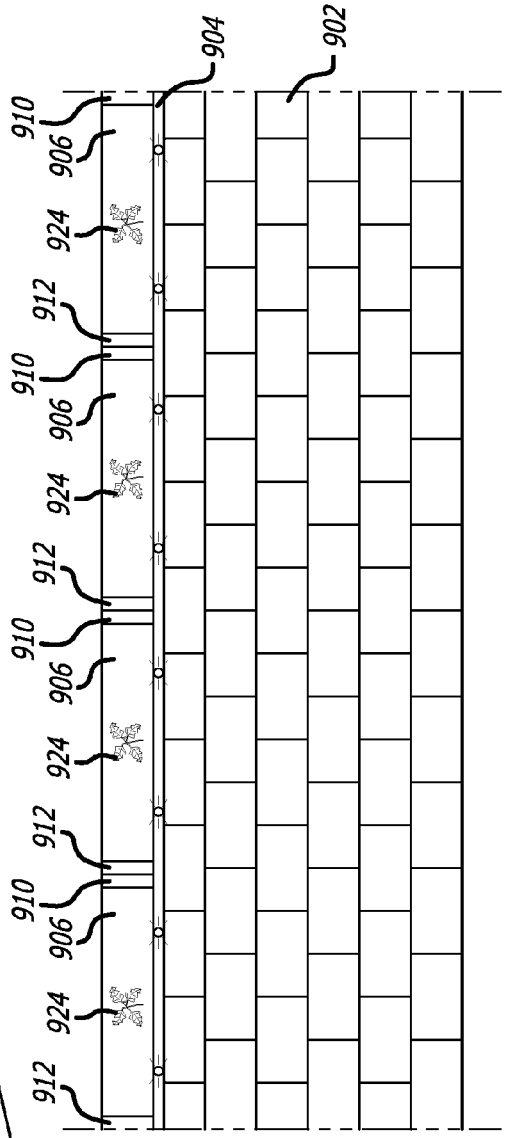
FIG. 11 is a front view of the security system of FIG. 9.

Another example embodiment is illustrated in FIGS. 9-11. Security system 900 includes wall 902 on which elongated coupling member 904 is attached. On top of elongated coupling member 904 is placed narrow partitioning member 906 that is at least partially transparent. At least one proximity sensor system (not illustrated) runs down channel(s) in elongated coupling member 904.

Positioning stakes 910, 912 can have several shapes and sizes depending on the type of wall 902 and narrow partitioning member 906 used. As illustrated in FIGS. 9-11, positioning stake 910 has an elongated shape with top end 914 and tapered bottom end 916 that terminated at point 918. Generally, from top end 914 to mid point 920, at least one slot 922 is present wherein each narrow partitioning member 906 is seated. Slot 922 is dimensioned based on the thickness of narrow partitioning members 906. Slot 922 is placed on one side of stake 118 and stakes are placed back to back when installed and can be angled as appropriate depending on turns in the wall. Bracket 922 is inserted within slot 922 before narrow partitioning member 906 is installed. This allows easier installation and repair of the system. Plus, stakes 910 can be all of one slot size and bracket 922 can be sized according to the thickness of the narrow partitioning member 906.

In one example embodiment, narrow partitioning member 906 can be, for example, ¼ in glass, Plexiglas or acrylic what is about 9 in tall by about 4 ft long. Other sizes are appropriate and can be crafted by skilled artisans.

Elongated coupling member 904 includes at least one light 908 that can illuminate either the interior of the wall, the exterior of the wall or both. Stakes 910 are installed on top of and through elongated coupling members 904. Generally, the location of stake 910 is measured and a core hole is drilled through elongated coupling members 904 and into wall 902, in the case it is formed of cinder or other block. Stake 910 can be driven down into the hole or the hole first filled with mortar which later sets around bottom end 916. In an alternate embodiment, bottom end 916 comprises a screw thread so that stake 910 can be screwed down into the hole.

After stake 910 is installed, a second stake 912 is installed opposite to stake 910 so that a partitioning member 906 can be installed between stakes 910 and 912. In most embodiments, it is desirable to abut stakes 910 and 912 back to back, but in some embodiments, a gap can be left between the two stakes.

Emblem 924 is included on narrow partitioning member 906. Any type of emblem such as a company pectin or logo, or association coat of arms or symbol can be located on the narrow partitioning member 906. Further narrow partitioning member 906 can be partially or totally frosted if it is glass, Plexiglas or acrylic. More than one emblem can also be included and color can also be used. In one embodiment, the glass can be frosted and the emblem(s) can be clear portraying a reverse scene. Other geographic shapes are within the scope of the description and options are endless for decoration purposes.

Security system 900 further includes controllers, proximity systems, power systems, lighting systems, communication systems, decorative partitioning systems and the like of other embodiments described herein.

Figure 12:
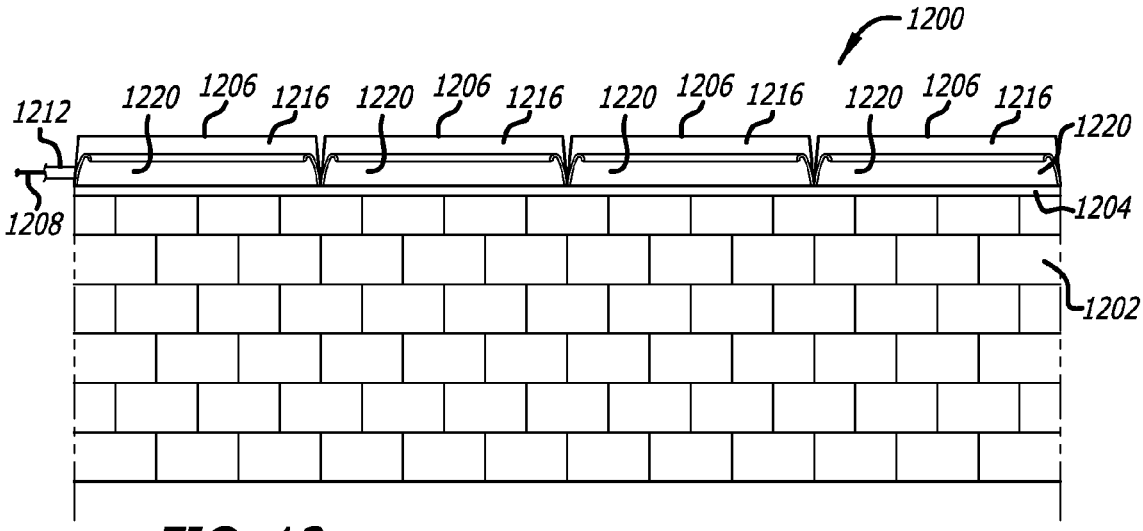
FIG. 12 illustrates another alternate security system according to the present disclosure.
Figure 13:
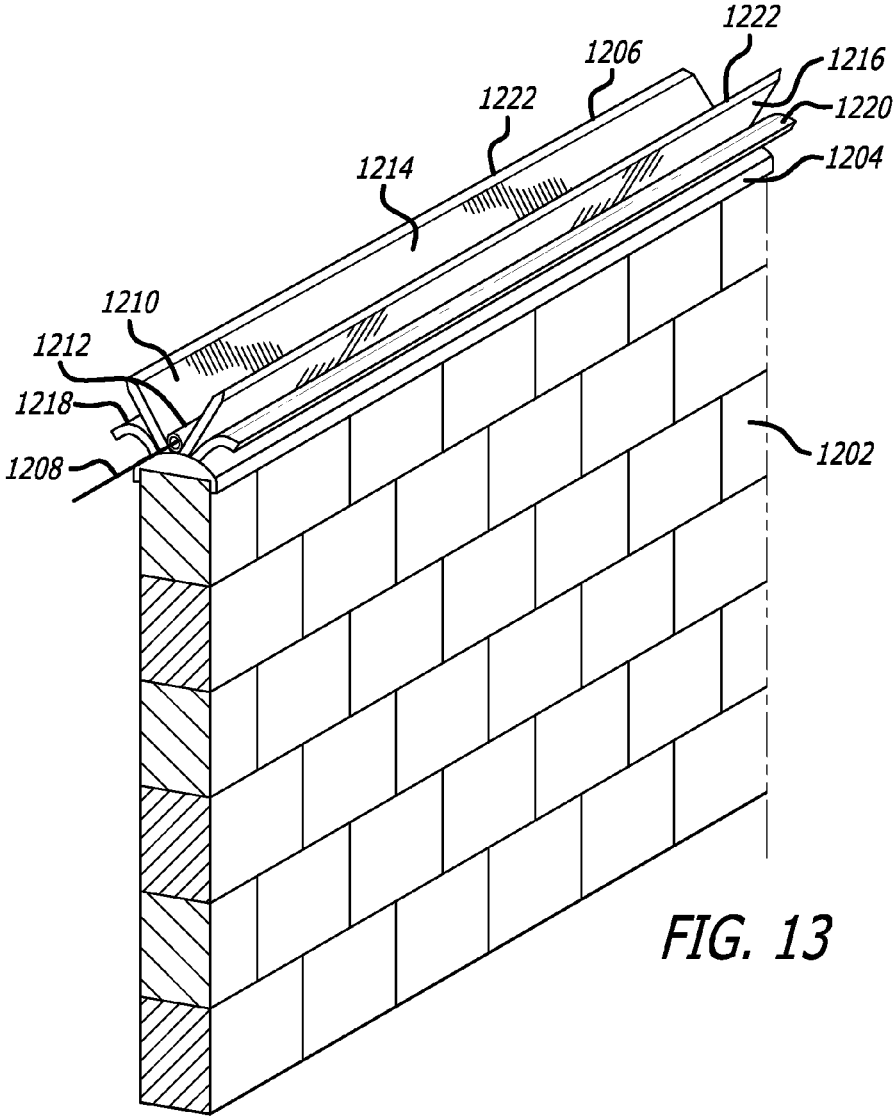
FIG. 13 is a perspective view of the security system illustrated in FIG. 12.

Another example embodiment is illustrated in FIGS. 12 and 13. Security system 1200 includes wall 1202 on which elongated coupling member 1204 is attached. On top of elongated coupling member 1204 is placed partitioning member array 1206 that is at least partially transparent. At least one proximity sensor system 1208 runs down center channel 1210 of partitioning member array 1206 within conduit 1212.

Each partitioning member array 1206 comprises first angled member 1214, second angled member 1216, first curved member 1218 and second curved member 1220. First angled member 1214 and second angled member 1216 are oriented at less than about 90 degrees relative to each other. Outer edge 1222 of first angled member 1214 and second angled member 1216 are sharpened as an added safety and defense measure.

Security system 1200 further includes controllers, proximity systems, power systems, lighting systems, communication systems, decorative partitioning systems and the like of other embodiments described herein.

Figure 14:
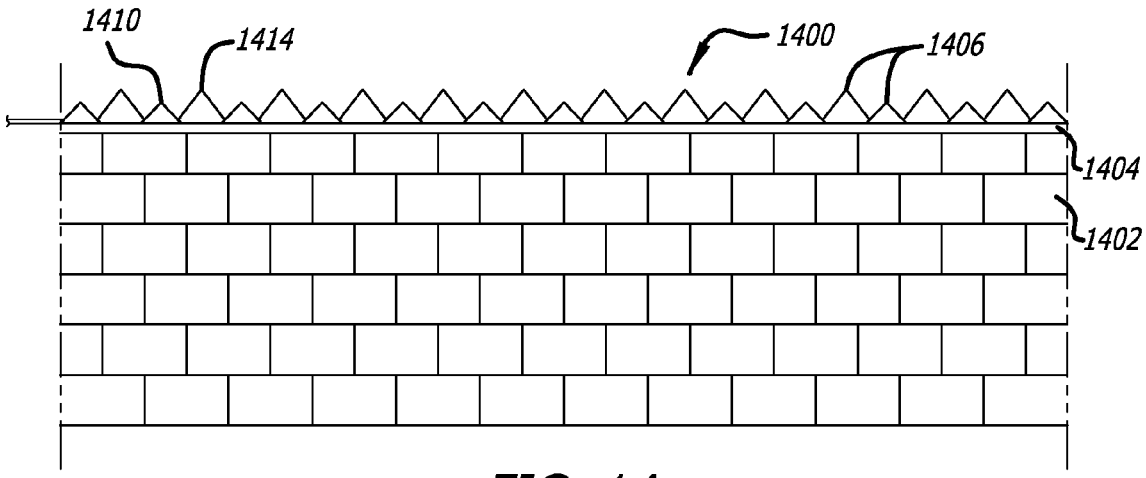
FIG. 14 illustrates yet another alternate security system according to the present disclosure.
Figure 15:
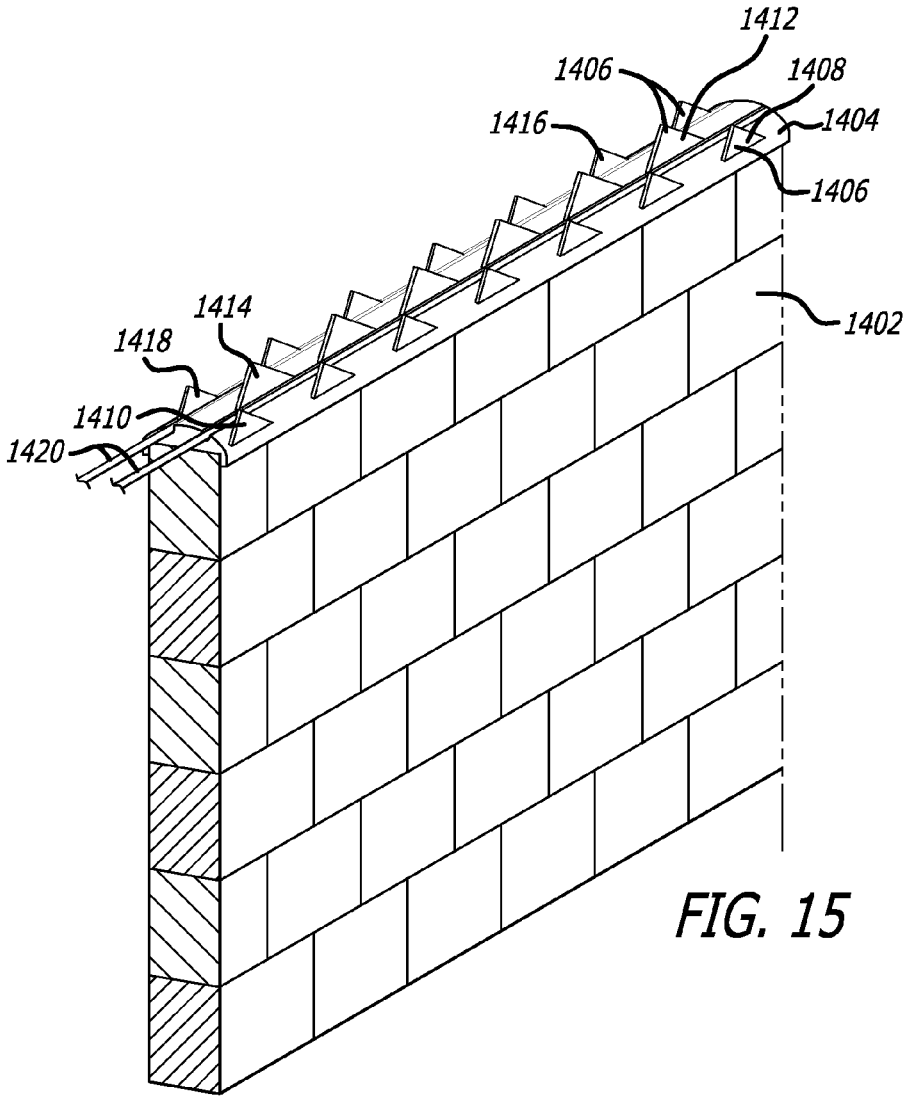
FIG. 15 is a perspective view of the security system illustrated in FIG. 14.

Still another example embodiment is illustrated in FIGS. 14 and 15. Security system 1400 includes wall 1402 on which elongated coupling member 1404 is attached. On top of elongated coupling member 1404 is placed alternating partition system 1406. Alternating partition system 1406 can include first row 1408 of smaller triangular members 1410, second row 1412 of larger triangular members 1414 which are staggered with first row 1408, and third row 1416 of smaller triangular members 1418 which are staggered with second row 1412 and in line with first row 1408. Each partitioning member can be at least partially transparent or can be non-transparent. In some embodiments, each partitioning member is sharpened as an added safety and defense measure. In other embodiments, only second row 1412 is sharpened to prevent accidental injury on first row 1408.

In some embodiments, each partitioning member is embedded within elongated coupling member 1404. Embedding allows for the partitioning members to be firmly attached. Also, for example, the partitioning members are formed of plexiglas and smaller triangular members 1410 are about 4 in long and larger triangular members 1414 are about 6 in long. In another embodiment, all partitioning members are the same height and are just of different length. Also, partitioning members can be rounded as opposed to triangular. Of course different size and shaped partitioning members can be crafted by a skilled artisan.

At least one proximity sensor system 1420 runs down a given length of elongated coupling members 1404 between first row 1408 and second row 1412, and second row 1412 and third row 1416. On other embodiments, proximity sensor system 1420 is embedded in elongated coupling members 1404. In FIG. 15, proximity sensor system is illustrated as a looped fiber optic system, but can also be replaced by a linear system. In other embodiments, the proximity sensor system can be laid outside first row 1408 and third row 1416.

Security system 1400 further includes controllers, proximity systems, power systems, lighting systems, communication systems, decorative partitioning systems and the like of other embodiments described herein.

Figure 16:
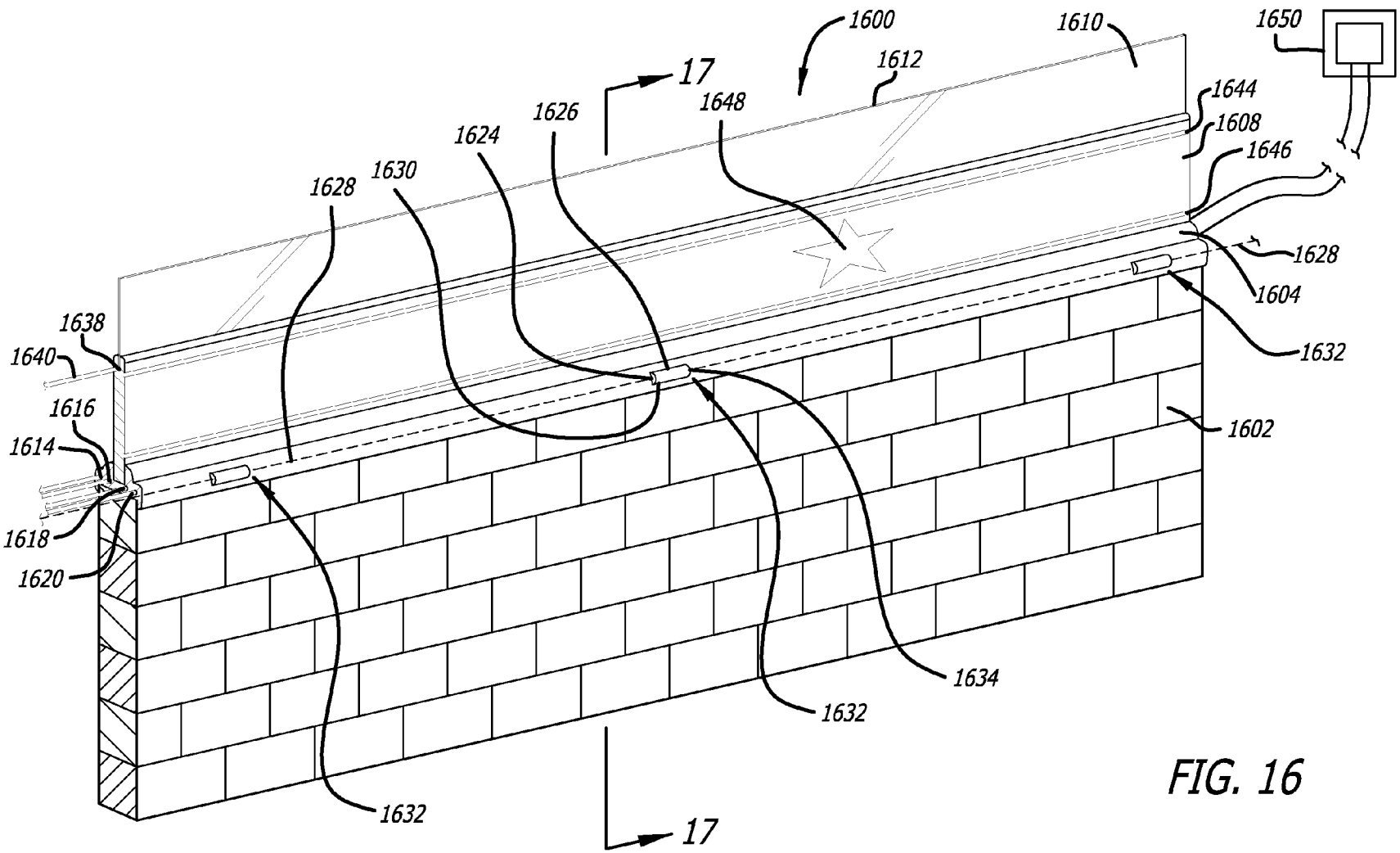
FIG. 16 illustrates still anther security system according to the present disclosure.
Figure 17:
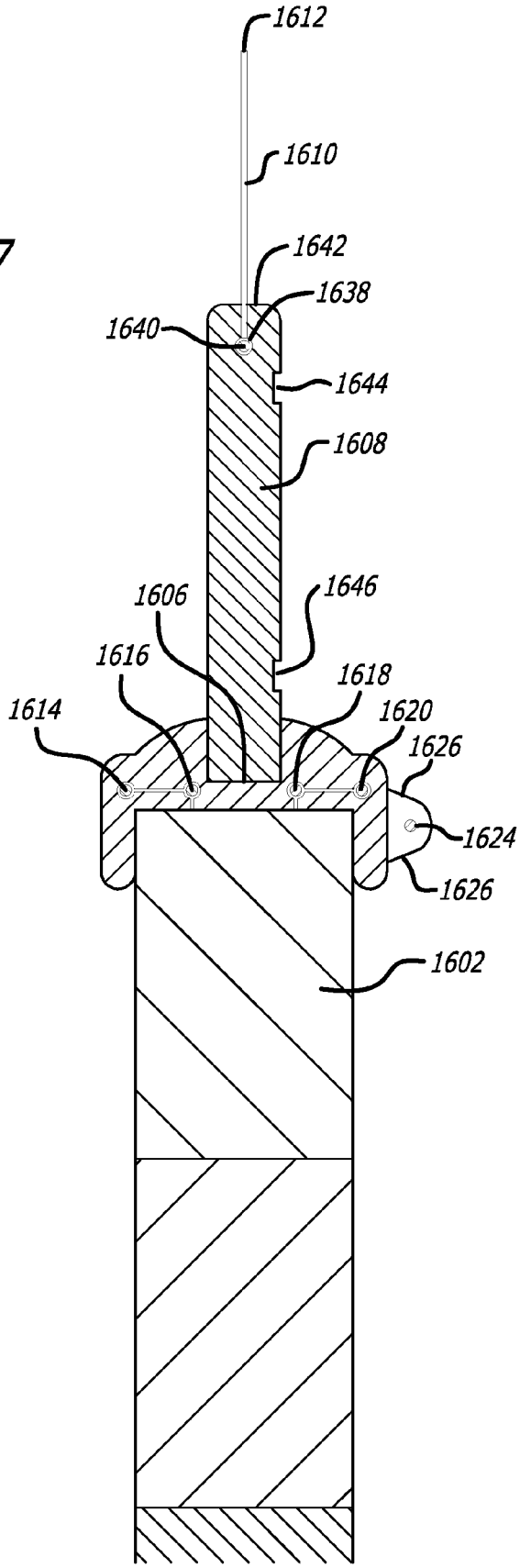
FIG. 17 is a cross-section of the security system illustrated in FIG. 16.

In another embodiment, security system 1600 is illustrated in FIGS. 16 and 17. Security system 1600 includes wall 1602 on which elongated coupling member 1604 is attached. Sitting atop elongated coupling member 1604 within coupling channel 1606 is vertical partitioning member 1608. On top of vertical partitioning member 1608 is placed partitioning member 1610. Partitioning member 1610 can be acrylic permitting might to pass through. Each partitioning member can be at least partially transparent or can be non-transparent. In some embodiments, partitioning member can be sharpened on top edge 1612 as an added safety and defense measure.

In one example embodiment, elongated coupling member 1604 is formed of 1.5 lb foam and vertical partitioning member 1608 is formed of 2 lb foam. Further, partitioning member 1610 is ⅛ inch acrylic.

Elongated coupling member 1604 can include a first channel 1614, a second channel 1616, a third channel 1618 and a forth channel 1620. Each channel can include various wiring components, for example, proximity sensor systems, DC power, or the like, or can be left vacant for future upgrades. And channel described herein can be left vacant upon installation to allow for future additions or upgrades. The interior of each channel can further be coated with any polymeric coating described herein allowing for easier fishing of wire through the channels once the system has been installed.

For example, on exterior side 1622 of wall 1602, third channel 1618 and forth channel 1620 can house a proximity sensor system such as a loop style system. In other embodiments, exterior side 1622 can further include a motion detection system. Such a system includes at least one laser 1624 housed within pod 1626. Laser light beam 1628 is emitted from first side 1630 of pod 1626 and is collected at sensor 1632 at second side 1634 of pod 1626. Breaking of laser light beam 1628 results in tripping of the proximity sensor system. Power can be provided to pod 1626 by a power wire 1636 originating in fourth channel 1620. In other embodiments, each pod is supplied with a battery.

Any laser beam system known in the art can be used with the present security systems. In an example embodiment, the laser light beam is a red visible laser light. In other embodiments, the laser light beam is a green visible laser light. In other embodiments, beams such as infrared beams that are not detectable to the human eye are desirable.

Further, security system 1600 includes fifth channel 1638 which can house a further proximity system or light strand 1640. Light strand 1640 is a strand of LED lights in a preferred embodiment which are long lasting and energy efficient. Partitioning member 1610 is placed atop light strand 1640 vertical channel 1642 so that light emitted from light strand 1640 will light up partitioning member 1610.

Vertical partitioning member 1608 is connected to elongated coupling member 1604 using any other the methods or adhesives described herein. Vertical partitioning member 1608 can further include decorative features such as first slot 1644 and second slot 1646 which add aesthetic appeal to the security system. Other slots of decorative features can be added to the wall as desired by a consumer. Further at least one emblem or design 1648 can be burned, sliced, branded, painted or the like into vertical partitioning member 1608.

Security system 1600 can further include at least one light (not illustrated) as described in other embodiments. Also, security system 1600 can be controlled by a controller 1650 which can include additional components as described herein.

Generally, to install a security system as described herein securing an area of land, steps such as, but not limited to, the following are utilized. First, at least one elongated coupling member is attached to a wall surrounding said area of land using adhesive bolts or both. Then, at least one partitioning member is placed on top of the wall to prevent an intrusion. After that, at least one proximity sensor system is associated with at least one of the elongated coupling member or the at least one partitioning member to detect an intrusion. Then, at least one light associated with the proximity sensor system and activatable by the proximity sensor system is used to locate the intrusion or warn an intruder. Finally, once installed, the area of land is secured.

The security systems described herein can further include an audible alarm. Speakers can be built into the stakes or horns, or other announcing devices can be associated with the wall. Audible alarms sounds can be emitted from the system or verbal warning can be echoed through the system.

The security systems described herein once installed and calibrated generally activate before an intrusion even takes place, for example, when motion is detected, when something is propped up against an elongated coupling member, or a partitioning member is touched.

The system alone, without being activated, provides several deterrents to prevent an intruder from even attempting to overcome the security systems. If warning signs or indications in or on the wall itself translate to a potential intruder, general fears of audible alarms or bright lights activated by the system can prevent a potential intrusion. Further, glass, plexiglas or acrylic used as partitioning members tends to leave finger prints which can prevent potential intrusion. Even further, the thought of glass itself is daunting. A potential intruder thinking about having to leverage his/her body up the wall by applying pressure to the glass would think about the fact the glass could shatter and cause bodily injury (not knowing the glass is tempered and in some cases think). Also, glass, plexiglas or acrylic can be sharpened on the top to prevent leveraging over the wall.

Further, in one example embodiment, a security system as described herein starts with an existing block wall (although a newly constructed wall is also an appropriate means), at least one foam member attached to the top of the existing block wall, at least one glass pane, at least one proximity sensor system situated within at least one groove within the at least one foam member; and at least one light associated with the proximity sensor system and activatable by the proximity sensor system, wherein the security system adds about six inches to about two feet of height to the existing block wall.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A security system comprising:

a plurality of elongated coupling members formed of compressed foam coated with a polymeric material configured to assemble and attach to a top of a wall, wherein the plurality of elongated coupling members provides at least a three inch vertical extension to the top of the wall, extends substantially an entire length of the wall, and comprises at least one conduit channel;

at least one proximity sensor system embedded in the at least one conduit channel wherein the at least one proximity sensor system is a pressure detection system; and at least one light associated with said proximity sensor system, wherein said light is activatable by said proximity sensor system.

2. The security system according to claim 1 wherein said compressed foam is polystyrene.

3. The security system according to claim 1 wherein said plurality of elongated coupling members is configured to attach to the wall using an adhesive.

4. The security system according to claim 1 wherein said security system further comprises at least one partitioning member selected from a pane of glass or acrylic.

5. The security system according to claim 4 further comprising at least one channel guide to secure said at least one partitioning member.

6. The security system according to claim 4 wherein the plurality of elongated coupling members comprises an indentation, wherein the at least one partitioning member is attached to the plurality of elongated coupling members at the indentation.

7. The security system according to claim 4 further comprising at least two positioning stakes, wherein each of the at least one partitioning member is held in position on the plurality of elongated coupling members by a pair of the at least two positioning stakes.

8. The security system according to claim 7 wherein each of the at least two positioning stakes has a top end and a bottom end, the bottom end terminating at a point.

9. The security system according to claim 8 wherein the top ends of the at least two positioning stakes includes a slot into which one side of the at least one partitioning member is positioned.

10. The security system according to claim 8 wherein the bottom ends of the at least two positioning stakes is anchored into one of the plurality of elongated coupling members.

11. The security system according to claim 1 wherein said at least one light is a light emitting diode.

12. The security system according to claim 1 wherein said plurality of elongated coupling members is between three inches and six feet in height.

13. The security system according to claim 1 wherein the at least one proximity sensor system runs lengthwise along the plurality of elongated coupling members.

14. The security system according to claim 1 wherein the at least one conduit channel runs lengthwise along the plurality of elongated coupling members, wherein the at least one proximity sensor is embedded in the at least one conduit channel.

15. The security system according to claim 1 wherein the at least one light is illuminable in a plurality of different colors and a plurality of different intensities.

16. The security system according to claim 15 wherein the control of at least one of the color and the intensity of the at least one light is determined based on an input from said proximity sensor system.

17. The security system according to claim 15 wherein the control of at least one of the color and the intensity of the at least one light is controllable by a manual input.

18. The security system according to claim 1 wherein the security system secures an enclosed perimeter of land.

19. The security system according to claim 1 wherein the security system surrounds an enclosed perimeter of land.

20. The security system according to claim 1 wherein the security system is configured to pinpoint the location of an intrusion.

21. The security system according to claim 1 wherein the security system is configured to dispatch authorities upon the detection of an intrusion.

22. The security system according to claim 1 wherein the compressed foam has a compression ratio of about 0.50, about 0.60, about 0.70, about 0.75, about 0.80, about 0.90 or about 1.0.

23. A security system comprising:

a plurality of elongated coupling members formed of compressed foam coated with a polymeric material configured to assemble and attach to a top of a wall, extends substantially an entire length of the wall, and comprises at least one conduit channel;

at least one proximity sensor system embedded in the at least one conduit channel wherein the at least one proximity sensor system is a pressure detection system; and at least one light associated with said proximity sensor system, wherein said light is activatable by said proximity sensor system.

* * * * *